United States Patent [19]

Mathis

[11] 4,008,661

[45] Feb. 22, 1977

[54] PRINTING PRESS FOR USE WITH BAG-MAKING MACHINES

[75] Inventor: Robert D. Mathis, Metropolis, Ill.

[73] Assignee: In-Line Equipment Company, Inc., Belknap, Ill.

[22] Filed: Mar. 20, 1975

[21] Appl. No.: 560,319

[52] U.S. Cl. ..... 101/181; 101/416 A; 101/219; 101/228; 226/44

[51] Int. Cl.[2] ..... B41F 13/02; B41F 5/06; B41F 23/04

[58] Field of Search ..... 101/416 A, 416 B, 416 R, 101/178, 181, 219, 228, 183; 226/44

[56] References Cited

UNITED STATES PATENTS

| | | | |
|---|---|---|---|
| 326,988 | 9/1885 | Jerome | 101/219 |
| 1,531,875 | 3/1925 | Ray | 197/129 |
| 1,878,319 | 9/1932 | Pinder | 101/416 A |
| 2,012,245 | 8/1935 | Meisel | 101/178 |
| 2,204,802 | 6/1940 | Gessler | 101/416 A |
| 2,768,576 | 10/1956 | Dietrich | 101/416 R |
| 2,946,280 | 7/1960 | Disch | 101/416 R |
| 2,970,535 | 2/1961 | Schmutz | 101/178 |
| 3,049,078 | 8/1962 | Smith | 101/228 |
| 3,084,623 | 4/1963 | Schollkopf | 101/178 |
| 3,160,094 | 12/1964 | Bean | 101/181 |
| 3,179,045 | 4/1965 | Evers | 101/181 |
| 3,233,539 | 2/1966 | Cahn | 101/181 |
| 3,592,133 | 7/1971 | Webendorfer | 226/44 |
| 3,835,776 | 9/1974 | Weidman | 101/183 |
| 3,913,900 | 10/1975 | Muster et al. | 226/44 |

*Primary Examiner*—Edgar S. Burr
*Assistant Examiner*—William Pieprz
*Attorney, Agent, or Firm*—Shapiro and Shapiro

[57] ABSTRACT

Compact rotary multi-color printing press for roll-fed webs, especially for use with machines for forming bags of polyethylene and the like. The press has a web feed arrangement which isolates a section of the web around a main drum and which varies the web speed with demand. Dryers are located adjacent to the main drum and in the base of the press, which is supported upon rollers so that the press may be readily moved to an operating site.

25 Claims, 7 Drawing Figures

PRINTING PRESS FOR USE WITH BAG-MAKING MACHINES

BACKGROUND OF THE INVENTION

This invention is concerned with printing presses and more particularly with presses for printing upon roll-fed webs supplied to bag-making machines.

The use of bags of polyethylene (poly) and other materials has expanded rapidly in recent years. It is frequently desirable to imprint informative and/or decorative matter upon the bags. The availability of poly bag-making machines of reasonable size and cost has encouraged the proliferation of small manufacturing establishments for poly bag making, but the unavailability of small, economical presses for printing upon roll-fed poly bag webs has restricted the ability of small bag-making establishments to meet the demand for printed bags. Heretofore bag printing, particularly multi-color printing, has required huge, complex, and expensive printing presses which only large bag-making establishments could afford. Hence, the cost of printed bags has been unduly high, and small bag-making establishments desiring printed bags have had to be satisfied with the high-cost practice of having the bag material printed by printing establishments specializing in that activity or by other, larger bag manufacturers.

BRIEF DESCRIPTION OF THE INVENTION

It is accordingly a principal object of the present invention to provide improved printing presses, particularly printing presses for use in conjunction with machines for making bags of poly or other material.

Another object of the invention is to provide printing presses of the aforesaid type which are compact enough to be readily movable to an operating site and which are simple and economical enough to permit widespread use, even by small bag-making companies.

Yet another object of the invention is to provide printing presses of the aforesaid type capable of printing upon a plurality of webs simultaneously.

Another object of the invention is to provide printing presses of the aforesaid type capable of high-accuracy, multi-color registration and capable of start-stop operation without loss of accuracy.

Briefly stated, in accordance with a preferred embodiment of the invention, a printing press comprises a frame having a base portion supported upon rollers, so that the press may be readily moved to an operating site adjacent to a bag-making machine, for example, and having an upright portion supporting one or more printing heads. In a two-color press, printing heads are located at opposite sides of a main drum, the webs to be printed being fed from a roll stand adjacent to a bag-making machine, passing over the base portion of the frame, then being trained upwardly toward the bottom of the main drum, upwardly around the drum and by the printing head at one side thereof, over the top of the drum, at which dryers are located, then downwardly around the drum by a printing head at the opposite side, and through a further dryer located in the base portion of the frame, and then to the bag-making machine. In moving between the second printing head and the dryer in the base portion of the frame, the web is trained about a dancer-bar assembly which responds to the web tension and which controls the drive mechanism of the press to vary the web speed with the bag-making machine's demand for web. Also, the web is trained onto the main drum via a guide roller and nip roller arrangement which isolates the section of web extending about the drum from the effects of varying web tension in the web supplied to and from the drum.

BRIEF DESCRIPTION OF THE DRAWINGS

The invention will be further described in conjunction with the accompanying drawings, which illustrate a preferred and exemplary embodiment, and wherein.

DETAILED DESCRIPTION OF THE INVENTION

Figure 2:
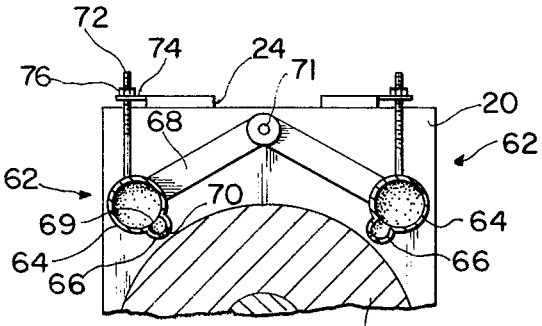
FIG. 2 is a vertical sectional view illustrating the dryer at the main drum.
Figure 1:
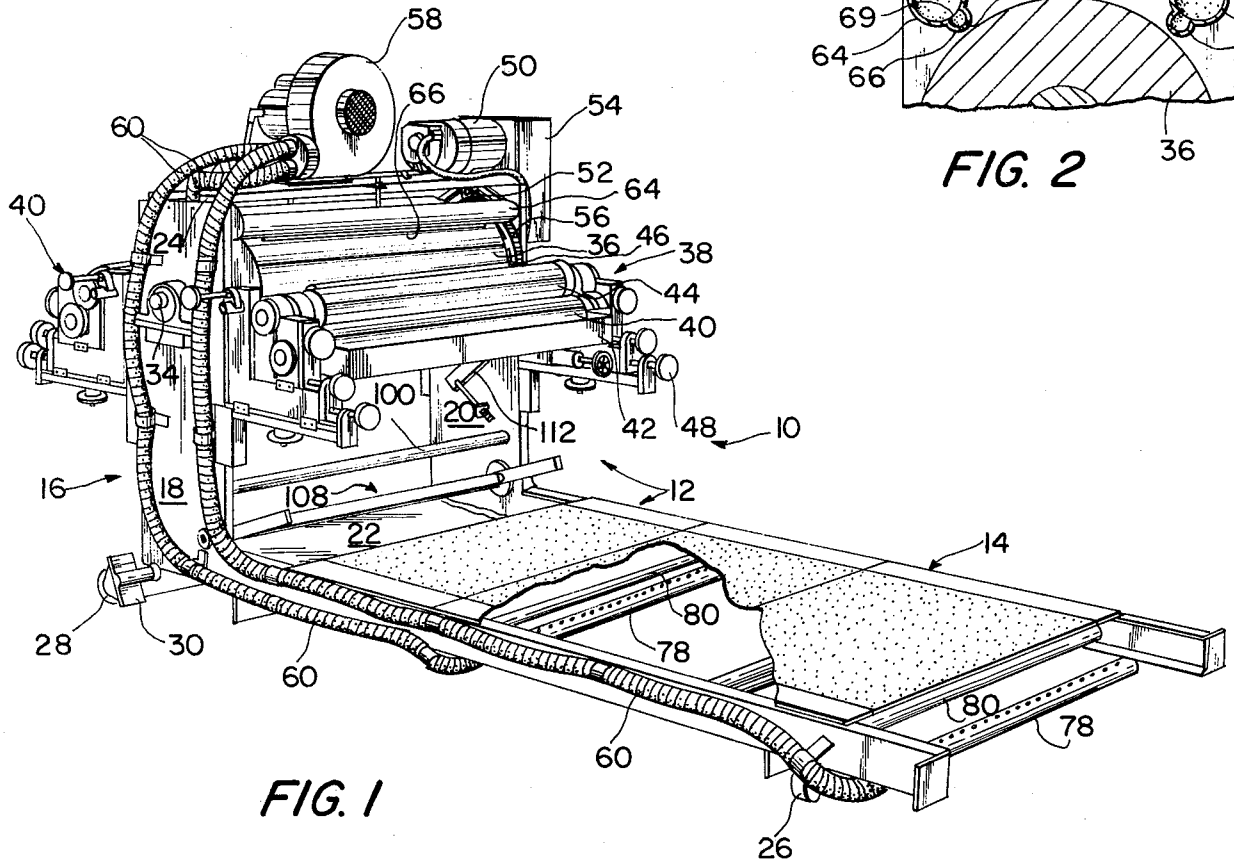
FIG. 1 is a perspective view of a printing press in accordance with the invention, as seen generally from the end of the press adjacent to the bag-making machine.

As shown in FIGS. 1 and 2, in a preferred embodiment the printing press 10 of the invention comprises a frame 12 having a base portion 14 and an upright portion 16. The base portion of the frame may comprise the usual types of steel framing members, such as longitudinal and transverse channels and plates, and the upright portion 16 may comprise spaced side plates 18 and 20 extending upwardly from one end of the base portion 14, the plates being braced at the top and bottom by transverse framing members 22 and 24. The base portion 14 is supported upon rollers 26 and 28 at opposite ends thereof so that the press may be easily moved about. Rollers 26 may be swivel casters, and rollers 28 may be supported upon brackets 30 pivotally connected to the frame, so that when the associated end of the press is lifted by a jack 32 attached to the frame, brackets 30 may be turned to place the associated rollers 28 under the brackets in order to support the press completely on rollers when it is desired to move the press. At other times the brackets 30 are turned to the position illustrated so that the associated end of the press is lowered to permit the rigid framing members of the press to engage the floor.

Rotatably supported near the top of the side plates 18 and 20, by means of bearings 34, is a main drum 36. Supported upon the side plates at opposite sides of the drum are printing heads 38 and 40. In a single-color press only one printing head, such as head 38, would be employed. The printing heads may be conventional, comprising a fountain roller 40, rotating through an ink tray 42, an Anilox or ink transfer roller 44, and a printing roller 46 upon which are placed printing bands (rubbers) having raised "type" receiving ink from roller 44 (received from roller 40) and transferring the ink impression to webs backed by the main drum 36. The printing heads comprise the usual bearings adjusted by screws 48.

The drive mechanism of the press comprises a D.C. electric motor 50, which may be mounted at the top of the upright portion 16 of the frame, the motor driving a pinion gear 52 via a gear train 54, and the pinion 52 driving a large gear 56 fixed to one end of drum 36. Gear 56 in turn drives a gear fixed to the end of printing roller 46, which is in turn coupled to gears fixed to the ends of the Anilox and fountain rollers for driving those rollers also, so that the drum 36 and the printing heads are driven in synchronism.

An electrically driven blower 58, which may also be mounted on top of the upright portion 16 of the frame, supplies drying air to dryers through hoses 60. One of the dryers is located adjacent to the top of the main drum 36 and comprises a pair of dryer assemblies 62 (see FIGS. 1-3). Each dryer assembly comprises a large pipe 64 (e.g., 2 inch diameter) extending along the length of the drum 36. Each pipe 64 has a smaller pipe 66 fixed thereto, the associated pipes being interconnected by holes 69 at intervals along the length of the pipes. Each pipe 66 has a series of perforations 70 along its length oriented to direct air substantially radially against and in close proximity to the drum 36. Each assembly 62 is supported by arms 68 at opposite ends thereof, the arms being pivotally supported at 71 upon the side plates of the frame. Each pipe 64 has a screw 72 fixed thereto and extending upwardly through a hole in a frame-mounted bracket 74, to receive a nut 76 which is adjusted on the screw to vary the position of the dryer assembly 62 with respect to the drum 36. The dryer assembly should be adjusted so that perforations 70 are very close to the web on the drum without touching the same. One end of pipes 64 and both ends of pipes 66 are closed. The other end of pipes 64 (closest to blower 58) is connected to the blower by a hose 60. Thus, pipes 64 are charged with drying air and serve as reservoirs for air supplied to pipes 66 and then ejected from perforations 70.

A further dryer is located in the base portion 14 of the frame and comprises a pair of pipes 78 with a row of upwardly facing perforations, each pipe 78 being closed at one end and connected to a hose 60 at the opposite end. As will be seen more clearly hereinafter, after being imprinted, the web passes through the dryer in the base portion 14, being guided through the base portion by a series of rollers 80, one of which is mounted above each dryer pipe 78 to back the web against the pressure of the air ejected from the dryer pipe.

Figure 3:
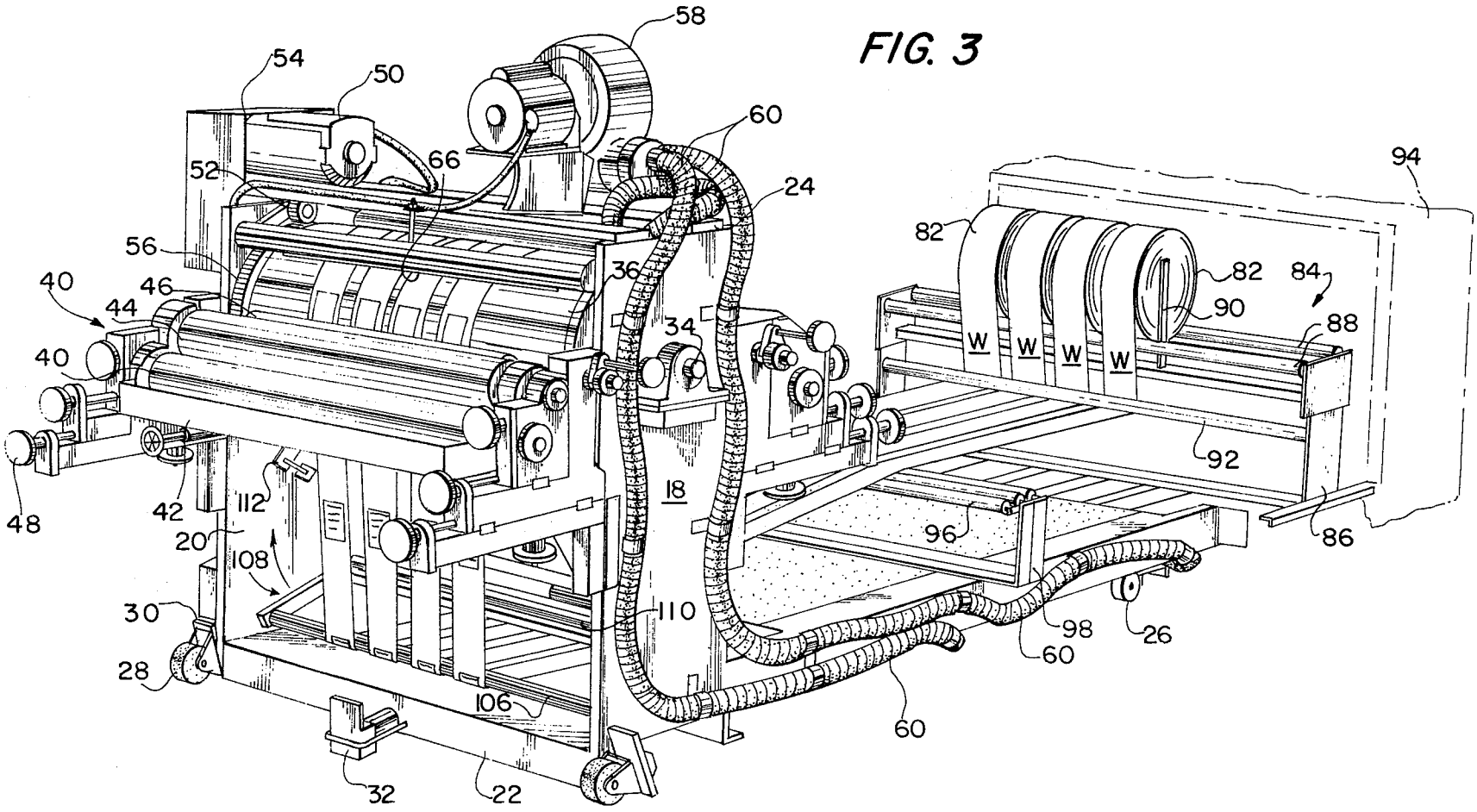
FIG. 3 is a perspective view of the printing press as seen from the end opposite FIG. 1 and illustrating the roll stand adjacent to the bag-making machine (shown in phantom lines)
Figure 4:
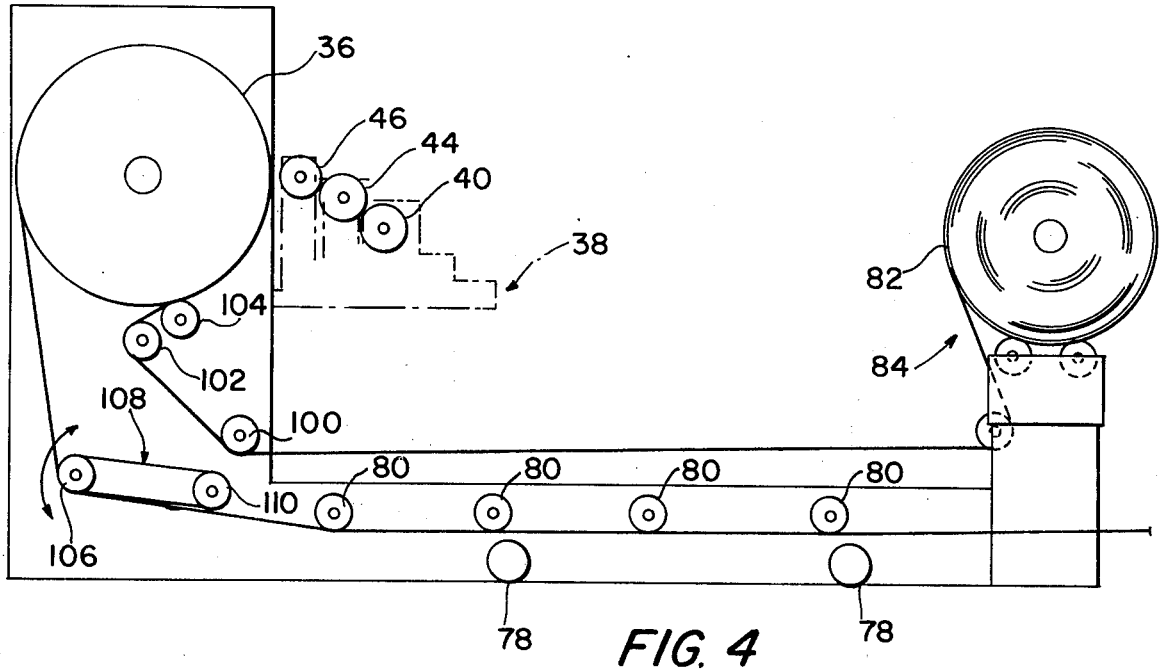
FIG. 4 is a diagrammatic side elevation view illustrating the web path through the printing press.

As shown in FIG. 3, the printing press of the invention is capable of handling simultaneously a plurality of webs W, which may be supplied from rolls 82 supported on a roll stand 84. The roll stand is conventional and in the form shown comprises a frame 86 having a pair of rollers 88 upon which the rolls 82 rest, the rolls being separated by vertical bars 90 and turning freely upon the rollers 88. In leaving rolls 82, the webs W may pass under additional roller 92. In the example shown, the roll stand is mounted beyond the end of the printing press 10 close to a bag-making machine 94. Alternatively, the roll stand may be mounted upon the end of the base portion 14 of the printing press frame, as indicated in FIG. 4. The bag-making machine may be any conventional type, such as the G & N, Weiss, Schjeldahl, or Gloucester, all well known bag-making machines. In general, bag-making machines have a roller arrangement which trains the web material fed into the machine in a series of back and forth passes to constitute a bank of web material to be formed into bags. Conventionally, the web material is fed by a capstan drive.

As shown in FIG. 3, in the use of the printing press 10 of the invention, the upright portion 16 of the frame is remote from the bag-making machine 94. If the roll stand 84 is supported beyond the opposite end of the frame of the printing press, it may be desirable to provide additional web supporting rollers 96 on a stand 98 supported upon the central region of the base portion 16 of the frame.

As shown in FIGS. 1 and 4, the webs enter the printing press by passing under guide roller 100 rotatably supported between side plates 18 and 20. Then the web passes upwardly to and around one side of a further guide roller 102, similarly mounted on the side plates, past a nip roller 104, around the drum 36, and then downwardly around a roller 106 of a dancer-bar assembly 108 (see FIG. 3) past a further roller 110 of the dancer-bar assembly, and then past rollers 80 previously mentioned. Rollers 80 are enclosed within the hollow boxlike base portion of the frame.

Figure 6:
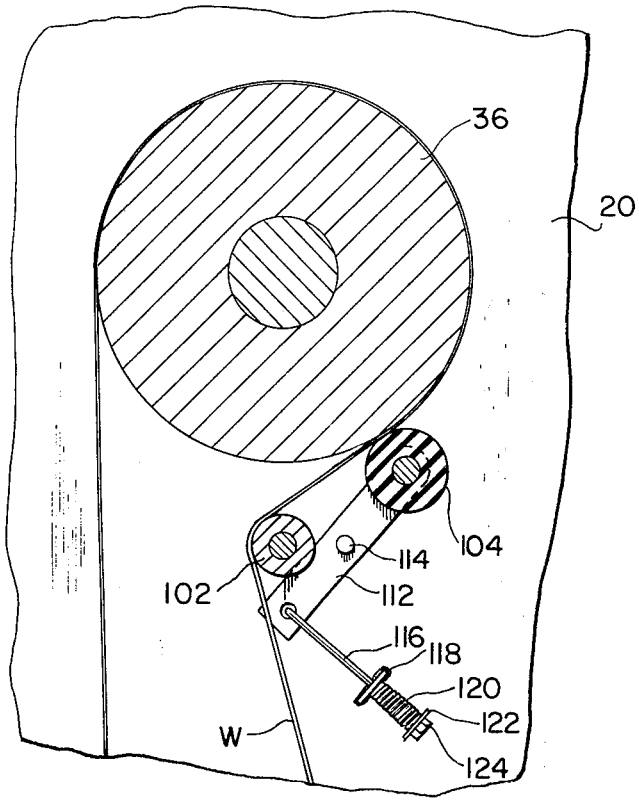
FIG. 6 is a fragmentary vertical sectional view illustrating the guide roller and nip roller arrangement adjacent to the main drum.

Guide roller 102 and nip roller 104 are shown more clearly in FIG. 6. Nip roller 104 is rotatably supported between a pair of arms 112 at one end thereof. Arms 112 are pivotally supported at 114 upon the corresponding side plates 18 and 20 at a point intermediate the ends of each arm, so that the nip roller may translate toward and away from the drum 36. The end of each arm opposite the nip roller 104 is pivotally connected to a screw 116 which passes through a hole in a bracket 118 fixed to the corresponding side plate and then receives a coil compression spring 120, one end of which engages the bracket 118 and the other end of which engages a washer 122 held in position by a nut 124 threaded onto the screw. The spring urges the nut end of the screw away from bracket 118 and hence turns the associated arm 112 to move the nip roller 104 toward drum 36, thereby pressing the web W against the drum. Roller 102, which may be a 1¼ inch diameter aluminum roller, for example, has its rotational axis located in the vertical plane containing the rotational axis of main drum 36 and is spaced slightly below the main drum. Nip roller 104, which may be a 3 inch diameter hard rubber roller (85–95 Durometer) has its rotational axis displaced about four inches from the vertical plane containing the axis of drum 36. Roller 102 is preferably positioned with respect to the drum and roller 104 so that the web passes onto the drum substantially along a plane tangent to the drum. By the provision of this nip roller assembly and by the provision of the dancer-bar assembly, which will now be described, the section of web passing around the drum is isolated from tension variations in the web supplied to and from the drum, so that accurate registration of multicolor impressions is obtained and maintained, even if the press is started and stopped.

Figure 5:
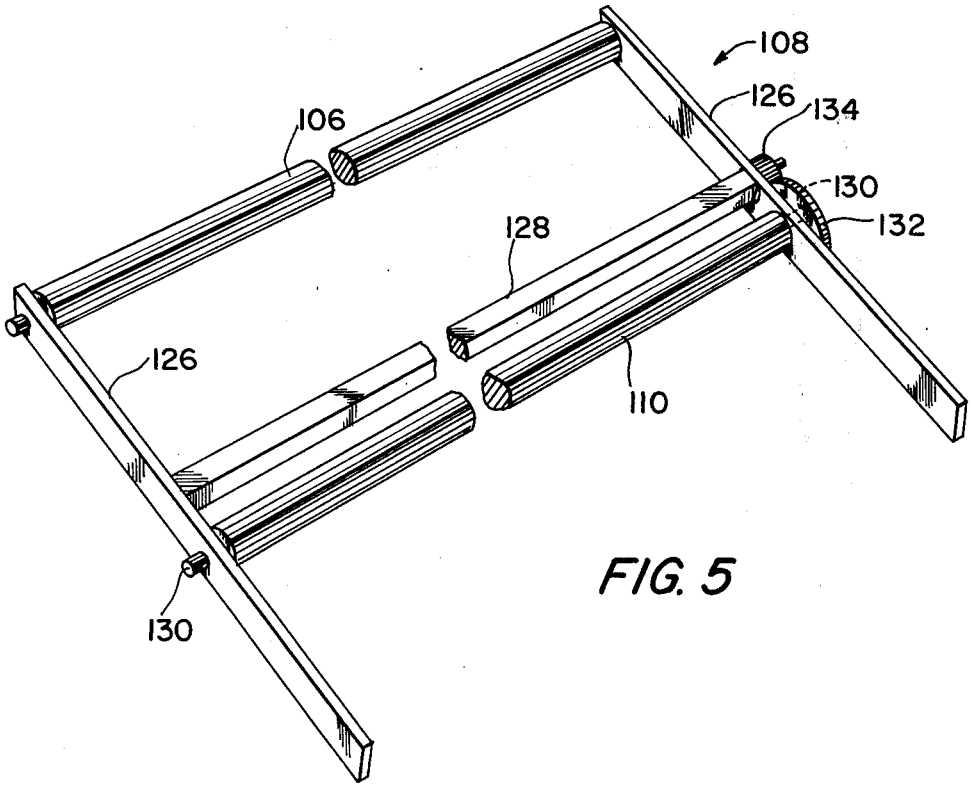
FIG. 5 is a contracted perspective view of the dancer-bar assembly.
Figure 7:
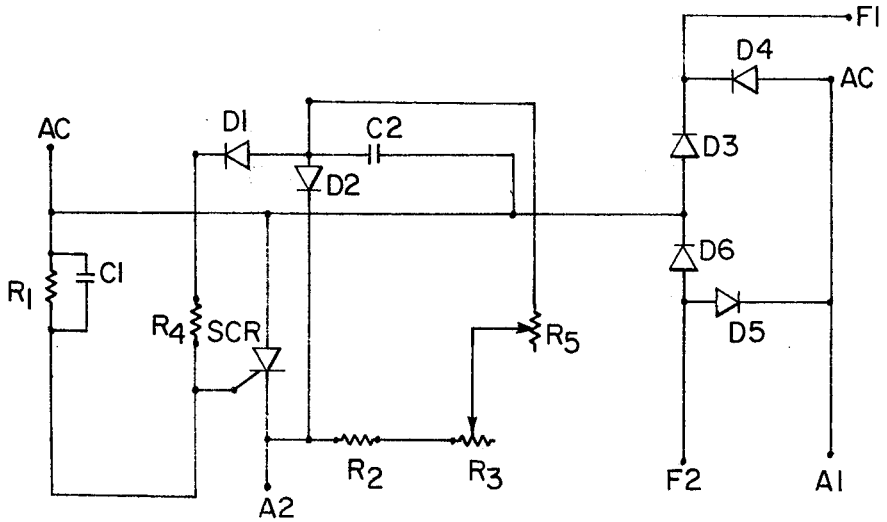
FIG. 7 is a schematic diagram of a motor control circuit employed in the invention.

The dancer-bar assembly 108 is shown more clearly in FIG. 5. It comprises a pair of side plate elements 126, a cross frame rod 128 fixed to a central region of elements 126, roller 106 rotatably supported upon one end of elements 126, and roller 110 rotatably supported upon elements 126 just ahead of frame member 128. The dancer-bar assembly 108 is supported upon the side plates 18 and 20 by means of pivots 130, so that roller 106 may translate in response to web tension. In the absence of substantial tension in the webs, the assembly turns to a position illustrated in FIGS. 1 and 3, but in operation the assembly turns to move tension-responsive roller 106 upwardly as illustrated in FIG. 4. A gear 132 is fixed about the pivot 130 at one side of the dancer-bar assembly so as to turn with the dancer-bar assembly. Gear 132 drives a further gear 134 rotatably supported upon side plate 20. Gear 134 adjusts a potentiometer R5 of a speed control circuit as shown in FIG. 7. The speed control circuit is conventional, comprising an SCR, so-labeled, diodes D1-D6, resistors R1, R2, and R4, potentiometers R3 and R5, and capacitors C1 and C2. The armature of the motor 50 is connected to terminals A1 and A2 and the field of the motor to terminals F1 and F2. Diodes D3–D6 constitute a bridge rectifier for AC applied to the terminals so-labeled. Movement of the dancer-bar assembly adjusts potentiometer R5 to control the firing of the SCR and thereby to adjust the speed of the motor proportionally through a range of movement. Potentiometer R3 sets a threshold for the starting of the motor. When roller 106 of the dancer-bar assembly is in its lowermost position, potentiometer R5 is adjusted to a resistance value at which the motor does not operate. When, however, the bag-making machine is turned on, withdraws web from its bank, and then draws web from the printing press, the tension in the web moves the roller 106 upwardly, turning the dancer-bar assembly clockwise in FIG. 4 and adjusting potentiometer R5 to start the motor. The speed of the motor is then maintained by potentiometer R5 in accordance with variations of the web tension in order to feed web through the printing press at a speed determined by the demand from the bag-making machine.

By virtue of the invention a printing press is provided that is compact and economical, that is capable of printing upon multiple webs (even of different materials) simultaneously, and that produces high quality printing without the registration and other problems that have troubled prior presses.

In a typical 2-color press constructed in accordance with the invention, the frame is about 8 feet long and 41 inches wide, with side plates about 40 inches high and 15 inches wide. The main drum is a 16 inch diameter chrome-plated steel drum driven by a 1 H.P. D.C. motor at an operating speed producing a linear web feed of about 200 feet per minute. All guide rollers except the nip roller are 1¼ inch diameter aluminum rollers, with the nip roller 3 inches in diameter and made of rubber as mentioned previously.

While a preferred embodiment of the invention has been shown and described, it will be apparent of those skilled in the art that changes can be made in this embodiment without departing from the principles and spirit of the invention, the scope of which is defined in the appended claims.

The invention claimed is:

1. A printing press for use with an adjacent machine having a demand for web from a supply, said press comprising a frame supporting a printing head thereon, means including a rotary drum backing said web at said printing head for feeding said web from said supply to said printing head and then to said machine, and means responsive to the tension of said web after it passes said drum for controlling the speed of said feeding means, and for varying the speed of said drum, to vary the rate at which said web is fed from said supply to said printing head and then to said machine in accordance with demand of said machine for said web.

2. A printing press in accordance with claim 1, wherein said frame comprises a base portion and an upright portion connected thereto, said upright portion supporting said printing head, and said base portion having a dryer therein and having means for guiding said web therethrough from said printing head, said base portion being supported upon rollers to permit said press to be moved to a position adjacent to said machine.

3. A printing press in accordance with claim 2, wherein said dryer comprises a plurality of perforated tubes extending transversely of the direction of movement of said web through said dryer and means for supplying drying gas to said tubes and wherein said means for guiding said web through said dryer comprises a plurality of rollers, at least some of which are adjacent corresponding tubes and serve to support said web adjacent to said tubes.

4. A printing press in accordance with claim 1, further comprising dryer means adjacent to said drum for drying printing on said web backed by said drum.

5. A printing press in accordance with claim 4 wherein said dryer means comprises a perforated tube extending along said drum, and means for supplying a drying gas to said tube.

6. A printing press in accordance with claim 5, wherein said supplying means comprises a tube of larger cross dimensions first-mentioned tube communicating therewith along its length.

7. A printing press in accordance with claim 4, wherein said printing head is mounted at one side of said drum and said dryer means is mounted above said drum, said web being fed onto said drum from below the drum.

8. A printing press in accordance with claim 7, further comprising a second printing head at the side of said drum opposite the first printing head for printing upon said web backed by said drum at said opposite side.

9. A printing press in accordance with claim 4, further comprising means for adjusting the position of said dryer means relative to said drum.

10. A printing press in accordance with claim 4, wherein said dryer means comprises a pair of spaced perforated tubes extending along said drum near the top thereof and having means for supplying drying gas thereto.

11. A printing press in accordance with claim 4, further comprising additional dryer means extending along a base portion of said frame, said web being trained from said drum and through said additional dryer means.

12. A printing press in accordance with claim 1, wherein said means for controlling the speed of said web feeding means comprises a dancer-bar assembly about which said web is trained after passing said drum, said dancer-bar assembly having a roller responsive to the tension of said web and being pivotally supported on said frame to move in response to variations of the web tension, said feeding means comprising an electric motor driving said drum, and said controlling means further comprising means responsive to the movement of said roller for proportionally varying the electric energy supplied to said motor through a range of said movement.

13. A printing press in accordance with claim 1, wherein said press has associated therewith a roll stand and wherein said web is supplied from rolls supported upon said stand.

14. A printing press in accordance with claim 13, wherein said stand has means for supporting a plurality of rolls of web and wherein said head has means for simultaneously printing upon webs fed side by side from a plurality of rolls.

15. A printing press in accordance with claim 1, wherein said drum being supported for rotation about a horizontal axis said web is supplied to said press from a roll, and said press having roller means for guiding said web to and from said drum.

16. A printing press in accordance with claim 15, wherein said roller means comprises a pair of adjacent rollers below said drum for guiding said web onto said drum, one of said rollers being spaced below said drum, and the other of said rollers being a nip roller receiving web from said one roller, being supported for translational movement toward and away from said drum and being spring-biased toward said drum for resiliently pressing such web against said drum near the bottom thereof.

17. A printing press in accordance with claim 16, wherein said one roller is supported for rotation about an axis substantially in plane containing the axis of rotation of said drum.

18. A printing press in accordance with claim 17, wherein said web is trained upwardly to said one roller, then about one side of said one roller, and then upwardly to said nip roller at the opposite side of said one roller.

19. A printing press in accordance with claim 16, wherein said rollers train said web substantially tangentially of said drum from roller to roller and onto said drum.

20. A printing press in accordance with claim 15, wherein said web-tension-responsive means comprises a roller about which said web is trained after leaving said drum, said roller being supported so that its axis of rotation moves in response to variations in web tension.

21. A printing press in accordance with claim 1, wherein said machine is a bag-making machine located adjacent to said printing press.

22. A printing press in accordance with claim 1, there being a pair of printing heads at spaced locations adjacent the periphery of said drum for printing on said web backed by said drum at said locations, said printing heads being driven in synchronism with said drum, and means training said web onto and off of said drum for substantially isolating a section of web around said drum and past said locations from forces applied to said web away from said drum so that the register of the printing at said heads is maintained.

23. A printing press comprising a rotary drum, means for training a web from a supply about said drum circumferentially and then to a machine having demand for said web, a pair of printing heads at spaced locations adjacent the periphery of said drum for printing on said web backed by said drum at said locations, and means for driving said drum and said printing heads in synchronism, said training means comprising a first assembly training said web onto said drum and a second assembly training said web off of said drum, said first assembly comprising a nip roller supported for translational movement toward and away from said drum and spring-biased for movement toward said drum to press said web resiliently onto said drum, and said first assembly further comprising an additional roller, said web being trained from said supply to said additional roller, then to said nip roller substantially tangentially of said drum, and then from said nip roller onto said drum substantially tangentially of said drum, said second assembly comprising a roller supported for translational movement in response to the tension of the web drawn from said drum, said first and second assemblies cooperating to substantially isolate a section of said web trained around said drum past said locations from forces applied to said web away from said drum so that the register of the printing at said heads is maintained.

24. A printing press in accordance with claim 23, further comprising means responsive to the movement of said tension-responsive roller for varying the speed of said drive means to vary the rate at which said web is fed from said supply to said printing head and then to said machine in accordance with demand of said machine for said web.

25. A printing press in accordance with claim 23, wherein said machine is a bag-making machine located adjacent to said printing press.

* * * * *